US009370786B2

(12) United States Patent
Pouliaude

(10) Patent No.: US 9,370,786 B2
(45) Date of Patent: Jun. 21, 2016

(54) SPRAY HEAD FOR A FLUID PRODUCT AND DISPENSER COMPRISING SUCH A SPRAY HEAD

(71) Applicant: APTAR FRANCE SAS, Le Neubourg (FR)

(72) Inventor: Florent Pouliaude, Fouqueville (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 14/425,064

(22) PCT Filed: Sep. 2, 2013

(86) PCT No.: PCT/FR2013/052008

§ 371 (c)(1),
(2) Date: Mar. 2, 2015

(87) PCT Pub. No.: WO2014/037655

PCT Pub. Date: Mar. 13, 2014

(65) Prior Publication Data

US 2015/0202638 A1 Jul. 23, 2015

(30) Foreign Application Priority Data

Sep. 4, 2012 (FR) ..... 12 58233

(51) Int. Cl.
*B05B 1/34* (2006.01)
*B05B 7/04* (2006.01)
(Continued)

(52) U.S. Cl.
CPC ..... *B05B 1/341* (2013.01); *B05B 1/3033* (2013.01); *B05B 1/3405* (2013.01);
(Continued)

(58) Field of Classification Search
CPC .... B05B 1/341; B05B 9/0403; B05B 1/3442; B05B 1/3431; B05B 11/3011; B05B 7/04; B05B 1/3033; B05B 1/3405; B05B 1/3436; B65D 83/20
USPC ..... 239/333, 337, 373, 433, 476, 482, 491, 239/492, 493, 543, 544
See application file for complete search history.

(56) References Cited

U.S. PATENT DOCUMENTS 3,550,860 A 12/1970 Dorman
4,187,985 A * 2/1980 Goth ..... B05B 7/063 239/337

(Continued)

FOREIGN PATENT DOCUMENTS

FR 1 602 460 A 11/1970
FR 2 399 282 A 3/1979

(Continued)

OTHER PUBLICATIONS

Communication dated Mar. 19, 2015, issued by the International Bureau of WIPO in counterpart Application No. PCT/FR2013/052008.

(Continued)

*Primary Examiner* — Steven J Ganey
(74) *Attorney, Agent, or Firm* — Sughrue Mion, PLLC

(57) ABSTRACT

A fluid spray head including a spray orifice, a swirl chamber including an end wall and a side wall, and swirl channels defining channel outlets that open out transversally to the dispensing axis X into the swirl chamber. Each channel defines a projection axis Y that extends into the swirl chamber from the channel outlet. The projection axes Y of the swirl channels extend away both from the end wall and from the peripheral side walls, which are both adjacent to the channel outlets so as to pass through the swirl chamber without passing along either the end wall or the peripheral side wall.

11 Claims, 2 Drawing Sheets

(51) Int. Cl.

| | |
|---|---|
| ***B05B 1/30*** | (2006.01) |
| ***B05B 11/00*** | (2006.01) |
| ***B65D 83/20*** | (2006.01) |
| ***B05B 9/04*** | (2006.01) |

(52) U.S. Cl.
CPC ..... *B05B 1/3431* (2013.01); *B05B 1/3436* (2013.01); *B05B 7/04* (2013.01); *B05B 9/0403* (2013.01); *B05B 11/3011* (2013.01); *B65D 83/20* (2013.01); *B05B 1/3442* (2013.01)

(56) References Cited

U.S. PATENT DOCUMENTS 5,358,179 A * 10/1994 Lund ..... B05B 1/26 239/333
5,388,766 A * 2/1995 Buisson ..... B05B 1/3436 239/333
5,711,488 A * 1/1998 Lund ..... B05B 1/3436 239/492
5,738,282 A * 4/1998 Grogan ..... B05B 1/12 239/492
7,938,342 B2 * 5/2011 Octeau ..... B05B 1/3436 239/476
2001/0022006 A1 9/2001 Tomita et al.

FOREIGN PATENT DOCUMENTS

WO 2006/059065 A1 6/2006
WO 2008/015409 A1 2/2008

OTHER PUBLICATIONS

International Search Report for PCT/FR2013/052008 dated Nov. 7, 2013.

* cited by examiner

SPRAY HEAD FOR A FLUID PRODUCT AND DISPENSER COMPRISING SUCH A SPRAY HEAD

CROSS REFERENCE TO RELATED APPLICATIONS

This application is a National Stage of International Application No. PCT/FR2013/052008 filed Sep. 2, 2013, claiming priority based on French Patent Application No. 12 58233 filed Sep. 4, 2012, the contents of all of which are incorporated herein by reference in their entirety.

The present invention relates to a fluid spray head comprising: a spray orifice defining a dispensing axis; a swirl chamber upstream from the spray orifice, the chamber being defined by inside walls; and swirl channels respectively defining channel outlets in the inside walls, which outlets open out transversally to the dispensing axis into the swirl chamber so as to generate a swirl flow inside the swirl chamber, each channel defining a projection axis that extends into the swirl chamber from the channel outlet. By way of example, such a spray head may be in the form of a pusher that is actuatable by means of one or more fingers of a hand. Advantageous fields of application of the present invention are the fields of perfumery, cosmetics, and pharmacy, without excluding other fields.

In the prior art, document FR 2 399 282 is known, which describes a conventional spray head including a dispenser orifice, a swirl chamber, and swirl channels that open out tangentially and transversally into the swirl chamber. In conventional manner, the swirl channels extend in a plane that is perpendicular to the dispensing axis defined by the spray orifice. As a result, the flows of fluid coming from the swirl channels penetrate into the swirl chamber passing along the end wall of the chamber. In addition, the flows of fluid also pass along the cylindrical side wall of the chamber, given that the swirl channels open out tangentially into the swirl chamber. Thus, the flows of fluid pass along both the end wall and the side wall of the swirl chamber, thereby generating considerable head loss. Phenomena of parasitic and uncontrolled flow are also generated.

Document FR 2 399 282 also describes another embodiment in which the swirl channels are formed in a frustoconical surface, and open out tangentially into the end wall of the swirl chamber that defines a frustoconical side wall having an open vertex that forms the spray orifice. More precisely, a nozzle forming the spray orifice and the frustoconical wall is engaged around a pin forming the end wall and a frustoconical surface in which the swirl channels are formed. Thus, the flows of fluid coming from the swirl channels penetrate into the swirl chamber, passing along the frustoconical wall of the swirl chamber towards the spray orifice. Once again, as a result of the flows passing along the frustoconical inside wall of the chamber, considerable head loss is generated as well as uncontrolled parasitic flow phenomena.

In the two embodiments in document FR 2 399 282, the spray chamber is responsible for significant head loss and for generating fluid-flow phenomena that harm the good quality of the spray through the spray orifice.

An object of the present invention is to remedy the abovementioned drawbacks of the prior art that are found in most dispenser heads provided with a chamber and swirl channels.

To do this, the present invention proposes that the projection axes Y of the swirl channels extend away both from the end wall and from the peripheral side walls which are both adjacent to the channel outlets, so as to pass through the swirl chamber without passing along either the end wall or the peripheral side wall.

In this way, the flows of fluid coming from the outlets of the swirl channels are no longer subject to parasitic laminar flow phenomena along the inside walls of the swirl chamber. The fluid may thus swirl without being disturbed in significant manner by the inside walls of the swirl chamber. In other words, the swirl is mainly generated flowing away from the inside walls of the swirl chamber. The head loss in the swirl chamber is thus considerably reduced, and this makes it possible to use swirl channels of small section. Specifically, the head loss already created by the swirl channels of small section is only increased a little in the swirl chamber of the invention. In addition, it should be observed that the channel outlets open out into the swirl chamber at the location where the end wall is connected to the peripheral side wall. Thus, the flows of fluid coming from the outlets of the swirl channels penetrate into the swirl chamber in substantially symmetrical manner relative to the side and end walls, and this considerably reduces parasitic turbulence.

According to an advantageous characteristic of the invention, the end wall is substantially plane, the channel outlets opening out into the swirl chamber at the end wall.

According to another advantageous characteristic of the invention, the chamber includes a front wall in which the spray orifice is formed, the projection axes being directed towards the front wall.

In still another aspect of the invention, the peripheral side wall is substantially cylindrical. The end and front walls may be parallel and plane. In a variant, the end wall may be concave or convex, as may the front wall. The peripheral side wall may be slightly frustoconical.

In an advantageous aspect of the present invention, the projection axes of the swirl channels extend transversally relative to the end wall and to the side wall, advantageously with an angle of about 45° relative to the end wall and relative to the side wall. This implies that the projection axes of the channels extend into the chamber away both from the end wall and from the side wall, and advantageously in completely symmetrical manner.

According to another advantageous characteristic of the invention, the swirl channels are formed in a frustoconical wall having an axis of revolution that coincides with the dispensing axis. In this way, the swirl channels may open out into the swirl chamber with a sloping orientation, both relative to the end wall that is advantageously perpendicular to the dispensing axis, and relative to the side wall that is advantageously cylindrical. The outlets of the swirl channels are advantageously formed in the end wall in manner that is directly adjacent to the cylindrical side wall. As a result of their sloping arrangement resulting from the frustoconical wall, the flows of fluid penetrate into the swirl chamber by flowing away both from the end wall and from the side wall, towards the front wall in which the spray orifice is formed.

In a practical embodiment, the spray head comprises a head body and a nozzle, the head body forming a pin that defines the end wall and the frustoconical wall, the nozzle being engaged around the pin, and between them they define the swirl chamber and the swirl channels, the nozzle defining the front wall, the side wall, and a frustoconical zone that comes into leaktight contact with the frustoconical wall of the pin so as to form the swirl channels, the nozzle advantageously being circularly symmetrical about the dispensing axis.

In another advantageous aspect of the invention, the channel outlets open out in non-tangential manner into the swirl chamber. This further improves avoidance of the flows of fluid coming from the outlets of the swirl channels flowing along the side wall of the swirl chamber.

Advantageously, the swirl chamber may present a thickness E in the direction of the dispensing axis, and a diameter D in the direction that is perpendicular to the dispensing axis, the ratio E/D being less than about 0.8, E advantageously being less than about 0.5 millimeters (mm).

In another aspect of the present invention, the swirl channels are rectilinear. Thus, the head losses are minimized, particularly when the channels present a small section.

The invention also defines a fluid dispenser comprising a reservoir, a pump mounted on the reservoir, and a spray head as defined above and associated with the pump. The dispenser head may be fitted on an outlet of the pump or incorporated in the pump. In most configurations, the spray head is in the form of a pusher fitted on the free end of the actuator rod of the pump.

The spirit of the invention resides in causing the flows of fluid coming from the swirl channels to flow away from the inside walls of the swirl chamber, so as to reduce the head losses and minimize the parasitic laminar flow phenomena. Naturally, the flows of fluid coming from the swirl channels penetrate into the swirl chamber via one of its inside walls, but the flows are oriented in such a manner that they flow away from the inside walls immediately.

The invention is described more fully below with reference to the accompanying drawings, which show an embodiment of the invention by way of non-limiting example.

The spray head of the present invention may be used at the outlet of any fluid dispenser device, e.g. a pump, a valve, a squeezable reservoir, etc. The spray head of the invention finds an advantageous application as a pusher that is manually actuatable by means of one or more fingers. The pusher may be incorporated in a pump or a valve, or preferably it may be fitted on the free end of an actuator rod forming an internal outlet duct. For a pump, the actuator rod is provided with a piston that slides in leaktight manner inside a cylinder formed in a pump body that is mounted in stationary manner on the opening of a reservoir. In conventional manner, the pump comprises a pump chamber that is provided with an inlet valve and with an outlet valve that may be carried by the actuator rod. Thus, by pressing the actuator rod into the pump body against a spring, the volume of the pump chamber decreases, thus putting the fluid that it contains under pressure. When the pressure reaches a predetermined value, the outlet valve opens and the fluid under pressure is forced through the actuator rod so as to reach the pusher that incorporates a spray head of the invention.

Figure 3:
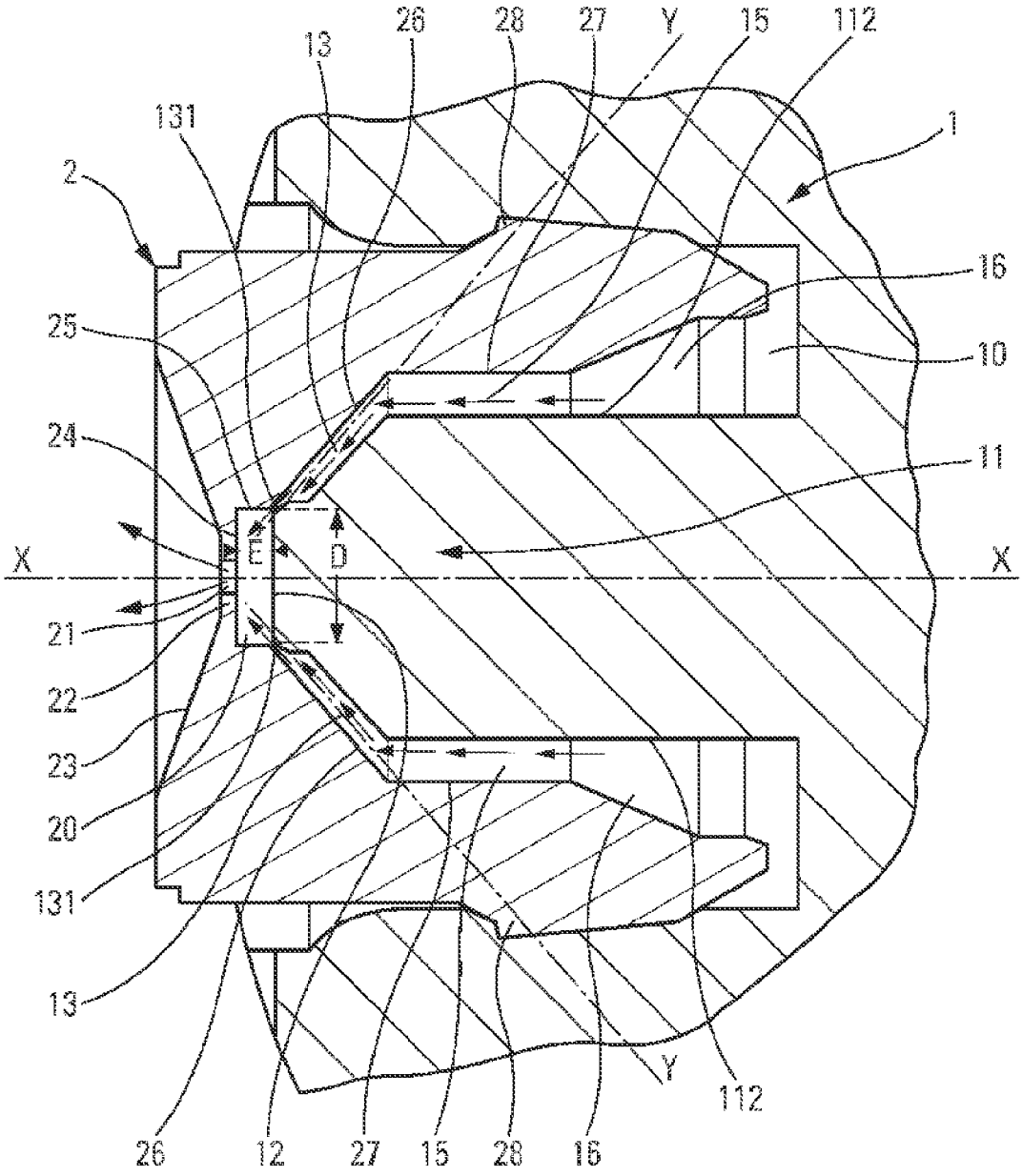
FIG. 3 is a horizontal cross-section view through the FIG. 1 spray head in its assembled state.

In a non-limiting embodiment of the invention, the spray head includes a head body 1 that may be made by injection molding an appropriate plastics material. The head body 1 may be made as a single part. In conventional manner, it comprises a connection sleeve for fitting on the free end of the actuator rod of a pump or a valve. The connection sleeve is connected to a housing 10 via a series of internal ducts and channels. The housing 10 is preferably cylindrical and opens out laterally onto the periphery of the head body. the housing 10 contains a pin 11 that projects outwards from the housing. Thus, an annular space is formed inside the housing 10 around the pin 11. In conventional manner, a nozzle 2 is fitted and inserted in stationary manner inside the housing 10 around the pin 11, as can be seen in FIG. 3. A series of internal ducts is defined between the pin 11 and the nozzle 2 so as to convey the fluid from the connection sleeve to a spray orifice 21 formed in the nozzle 2. Although not shown, the spray head may also be provided with a covering hoop that sheathes the head body 1 in attractive manner, leaving the nozzle 2 visible.

Figure 1:
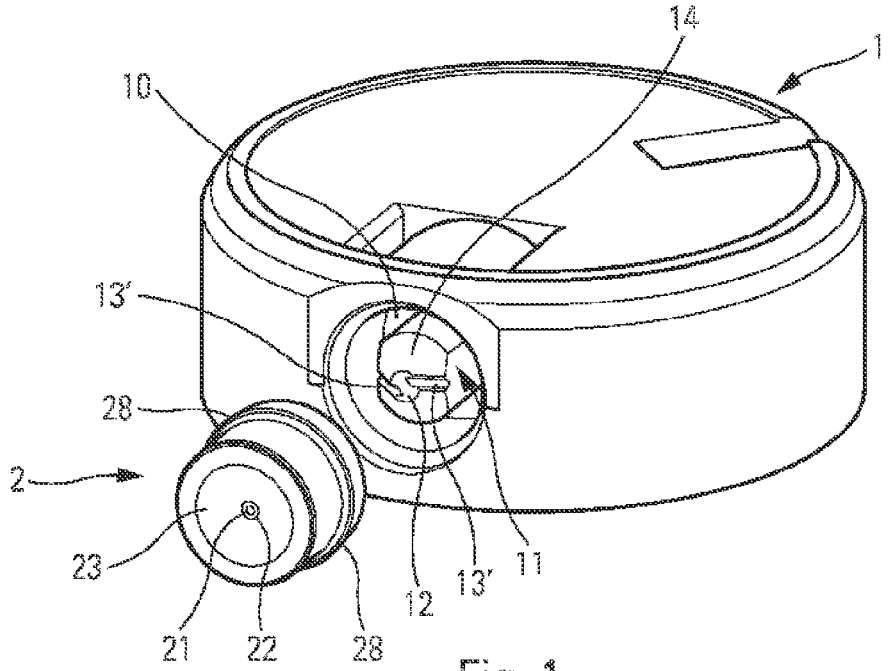
FIG. 1 is an exploded perspective view of a dispenser head constituting an embodiment of the present invention.
Figure 2:
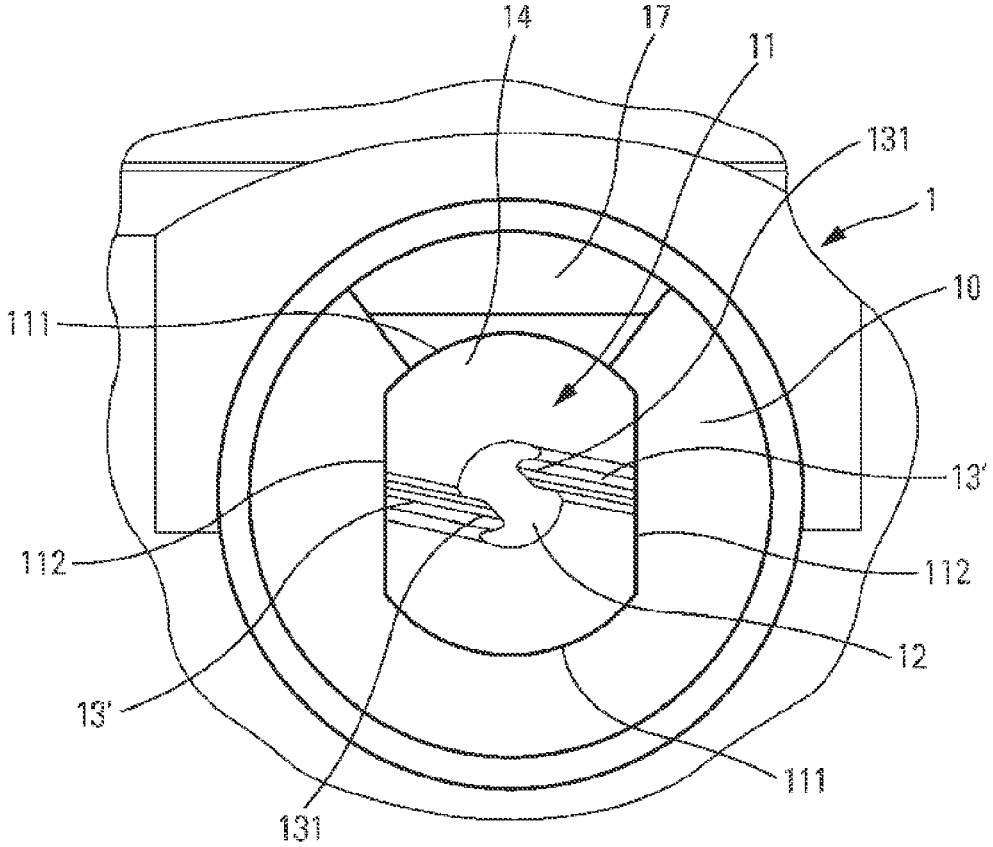
FIG. 2 is a greatly enlarged elevation view of a detail of the FIG. 1 head body.

With reference to FIG. 2, the housing 10 and the pin 11 that it contains can be seen in greatly enlarged manner. In this embodiment, the housing 10 presents a configuration that is substantially circularly cylindrical. The pin 11 is arranged in substantially central manner inside the housing 10 and presents a cross-section that is oblong, with two rounded sectors 111 and two flats 112. The front face of the pin 11 that faces outwards from the housing 10 presents a complex structure that is described below. With reference once more to FIG. 2, it can be seen that the front face is mainly defined by a frustoconical wall 14 having an axis of revolution that coincides with the axis of the pin and the dispensing axis X, as described below. The frustoconical wall 14 is truncated on its outer periphery, but also at its center in such a manner as to define an end wall 12 that, in this embodiment, is substantially plane and perpendicular to the axis of revolution of the frustoconical wall 14. In the invention, the frustoconical wall 14 is formed with two grooves or cuts 13' that extend from flats 112 in the frustoconical wall 14 to the end wall 12, into which they open out thereby forming channel outlets 131. It should be observed that the grooves or cuts 13' reach the end wall 12 in non-tangential manner. In FIG. 2, it should also be observed that a common duct 17 connects the housing 10 to a well forming the connection sleeve.

Reference is made below to FIG. 3 in order to describe in detail the nozzle 2 and its co-operation with the housing 10 and its pin 11. The nozzle 2 is preferably circularly symmetrical around the dispensing axis X passing through the spray orifice 21. Thus, it is not necessary to give the nozzle 2 any particular orientation while inserting it in the housing 10 of the head body 1. The spray orifice 21 is formed at a dispenser wall 22 of small thickness. The spray orifice 21 is in the form of a borehole that is completely or substantially cylindrical and that passes through the thickness of the dispenser wall 22. Around the wall 22, the nozzle forms a diffuser cone 23 that promotes the formation of a good quality spray. Internally, the dispenser wall 22 forms a front wall 24 that may be completely or substantially plane, or slightly concave, convex, or frustoconical. The front wall 24 is interrupted at its center by the spray orifice 21. The nozzle 2 also forms a peripheral side wall 25 that may present a cylindrical configuration around the dispensing axis X. In a variant, it is also possible to make the side wall 25 with a configuration that is frustoconical or more possibly complex. Beyond the side wall 25, the nozzle 2 forms a frustoconical section or zone 26 that presents a solid angle that is identical to the angle of the frustoconical wall 14 of the pin 11. Thus, the frustoconical section or zone 26 may come into intimate leaktight contact with the frustoconical wall 14, so that between them they isolate swirl channels 13 formed by the cuts or grooves 13'. The swirl channels 13 opens out via the channel outlets 131 into a substantially-cylindrical volume that is defined between the end wall 12 of the pin 11, the front wall 24, and the side wall 25 of the nozzle 2. The internal volume constitutes a swirl chamber 20 having its inlet defined by the channel outlets 131, and its outlet defined by the spray orifice 21. The channel outlets 113 are not directly tangential to the side wall 25, but slightly offset towards the inside of the swirl chamber 20. The chamber may present a thickness E in the direction of the dispensing axis X of about 0.5 mm, and a diameter D in the direction that is perpendicular to the dispensing axis X of about 0.7 mm. In empirical manner, it should be observed that the ratio E/D is preferably less than about 0.8.

In the invention, the swirl channels 13 that are advantageously rectilinear, thus define projection axes Y that penetrate into the swirl chamber 20 via two channel outlets 131 and they extend inside the chamber 20 obliquely without passing along either the end wall 12 or the side wall 25. As can be seen in FIG. 3, the two projection axes Y extend into the chamber 20 from the end wall substantially where it joins the cylindrical wall 25. Thus, the two projection axes Y extend into the swirl chamber 20 with an angle of about 45° relative to the end wall 12 and relative to the side wall 25. As a result, the flow of fluid that penetrates into the swirl chamber 20 flows immediately and progressively away from the end and side walls 12, 20, and towards the front wall 24 in which the spray orifice 21 is formed. Naturally, as a result of penetrating substantially tangentially into the swirl chamber 20, the flows of fluid coming from the swirl channels 13 generate a swirl or vortex of fluid inside the chamber before passing through the spray orifice 21. Without going beyond the ambit of the present invention, it can clearly be seen that the end wall 12 and the side wall 25 could be made with various configurations, providing the flows of fluid that penetrate into the swirl chamber 20 along the axes Y do not pass along the end and side walls 12, 25. The object of the present invention is to avoid any laminar flow along the inside walls of the swirl chamber 20. By forming the swirl channels 13 in a frustoconical wall, said swirl channels are oriented obliquely relative to the dispensing axis X, such that the flows of fluid that penetrate into the swirl chamber 20 do not pass along any of the inside walls, given that the end wall 12 is substantially or generally perpendicular to the axis X, and given that the side wall 25 is generally or substantially cylindrical.

Upstream from the swirl channels 13, the pin 11 and the nozzle 2 form two feed channels 15 followed by an annular channel 16 common to both feed channels and that communicates even further upstream with the common duct 17 visible FIG. 2. In this embodiment, the feed channels 15 are formed between the flats 112 of the pin 11 and the inside wall 27 of the nozzle 2. In order to hold the nozzle 2 stationary and in leaktight manner inside the housing 10, it includes leaktight fastener means 28 in the form of projecting profiles that provide leaktight fastening inside the housing 10.

As a result of the flows of fluid coming from the swirl channels 13 penetrating into the swirl chamber without passing along any of the inside walls, head losses in the swirl chamber 20 are reduced by avoiding phenomena associated with parasitic volumes of laminar flow. This characteristic is even more advantageous since it makes it possible for the swirl channels 13 to be made with small flow sections that generate significant head loss. Thus, the head loss generated by the small sections of the swirl channels allow a swirl or vortex to be obtained inside the swirl chamber 20 without head loss therein.

Although the spray head of the invention is described above with two swirl channels 13, it is possible to provide only one or, on the contrary, more than two, without going beyond the ambit of the invention. In this embodiment, the swirl channels are fed by a common internal duct 17 and a common annular channel 16: however, provision could also be made for the channels 13 to be fed in completely independent manner via their own respective ducts.

By means of the invention, a spray head is obtained that has small head loss and no parasitic laminar effect.

The invention claimed is:

1. A fluid spray head comprising:

a spray orifice defining a dispensing axis X;

a swirl chamber upstream from the spray orifice, the chamber including an end wall that is substantially perpendicular to the dispensing axis X, and a peripheral side wall; and swirl channels respectively defining channel outlets that open out transversally to the dispensing axis X into the swirl chamber so as to generate a swirl flow inside the swirl chamber, each channel defining a projection axis Y that extends into the swirl chamber from the channel outlet;

wherein the projection axes Y of the swirl channels extend away both from the end wall and from the peripheral side walls which are both adjacent to the channel outlets so as to pass through the swirl chamber without passing along either the end wall or the peripheral side wall.

2. A spray head according to claim 1, wherein the end wall is substantially plane, the channel outlets opening out into the swirl chamber at the end wall.

3. A spray head according to claim 1, wherein the swirl chamber includes a front wall in which the spray orifice is formed, the projection axes Y being directed towards the front wall.

4. A spray head according to claim 1, wherein the peripheral side wall is substantially cylindrical.

5. A spray head according to claim 2, wherein the projection axes Y of the swirl channels extend transversally relative to the end wall and to the side wall, advantageously with an angle of about 45° relative to the end wall and relative to the side wall.

6. A spray head according to claim 1, wherein the swirl channels are formed in a frustoconical wall having an axis of revolution that coincides with the dispensing axis X.

7. A spray head according to claim 1, comprising a head body and a nozzle, the head body forming a pin that defines the end wall and the frustoconical wall, the nozzle being engaged around the pin, and between them they define the swirl chamber and the swirl channels, the nozzle defining the front wall, the side wall, and a frustoconical zone that comes into leaktight contact with the frustoconical wall of the pin so as to form the swirl channels, the nozzle advantageously being circularly symmetrical about the dispensing axis X.

8. A spray head according to claim 1, wherein the channel outlets open out in non-tangential manner into the swirl chamber.

9. A spray head according to claim 1, wherein the swirl chamber presents a thickness E in the direction of the dispensing axis X, and a diameter D in the direction that is perpendicular to the dispensing axis X, the ratio E/D being less than about 0.8, E advantageously being less than about 0.5 mm.

10. A spray head according to claim 1, wherein the swirl channels are rectilinear.

11. A fluid dispenser comprising a reservoir, a pump mounted on the reservoir, and a spray head according to claim 1 and associated with the pump.

* * * * *